US008820836B2

(12) United States Patent
Stewart et al.

(10) Patent No.: US 8,820,836 B2
(45) Date of Patent: Sep. 2, 2014

(54) SEATING

(75) Inventors: Rebecca Stewart, London (GB); James Cross, Oxford (GB)

(73) Assignee: Ove Arup & Partners International Limited (GB)

( * ) Notice: Subject to any disclaimer, the term of this patent is extended or adjusted under 35 U.S.C. 154(b) by 580 days.

(21) Appl. No.: 13/054,520

(22) PCT Filed: Jul. 15, 2009

(86) PCT No.: PCT/GB2009/001745

§ 371 (c)(1),
(2), (4) Date: Apr. 14, 2011

(87) PCT Pub. No.: WO2010/007364

PCT Pub. Date: Jan. 21, 2010

(65) Prior Publication Data

US 2011/0187169 A1 Aug. 4, 2011

(30) Foreign Application Priority Data

Jul. 15, 2008 (GB) ..... 0812972.8

(51) Int. Cl.
*A47C 1/121* (2006.01)

(52) U.S. Cl.
USPC ..... 297/335; 297/232; 297/332

(58) Field of Classification Search
USPC ..... 297/232, 332, 335
See application file for complete search history.

(56) References Cited

U.S. PATENT DOCUMENTS

| | | | | |
|---|---|---|---|---|
| 3,889,999 | A * | 6/1975 | Mackintosh | 297/248 |
| 4,189,876 | A * | 2/1980 | Crossman et al. | 52/9 |
| 4,790,594 | A | 12/1988 | Temos | |
| 4,989,915 | A | 2/1991 | Hansal | |
| 5,083,836 | A | 1/1992 | Beasley | |
| 5,328,231 | A | 7/1994 | Raymond | |
| D386,320 | S | 11/1997 | King | |
| 5,984,417 | A * | 11/1999 | Wang | 297/440.14 |
| 6,179,362 | B1 * | 1/2001 | Wisniewski et al. | 297/335 |
| 6,890,032 | B2 * | 5/2005 | Fewchuk | 297/335 |
| D509,372 | S | 9/2005 | King | |
| 7,204,553 | B2 * | 4/2007 | Olarte | 297/332 |
| 7,950,507 | B2 * | 5/2011 | Figueras Mitjans | 297/332 |
| 7,950,739 | B2 * | 5/2011 | King | 297/333 |
| 2003/0075946 | A1 | 4/2003 | Neale et al. | |
| 2004/0084943 | A1 * | 5/2004 | Fisher | 297/335 |
| 2005/0168031 | A1 | 8/2005 | Olarte | |
| 2007/0107178 | A1 | 5/2007 | Olarte | |

FOREIGN PATENT DOCUMENTS

| | | | |
|---|---|---|---|
| AU | 4886379 | A1 | 3/1980 |
| DE | 10253186 | A1 | 6/2004 |
| GB | 409359 | A | 4/1934 |

(Continued)

OTHER PUBLICATIONS

International Search Report PCT/GB2009/001745; Dated Oct. 6, 2009.

*Primary Examiner* — Peter Brown
(74) *Attorney, Agent, or Firm* — Cantor Colburn LLP

(57) ABSTRACT

A seating arrangement for stadia and the like includes a beam for receiving one or more seats, where the seat has a backrest portion fixedly mounted to the beam and a movable seat portion mounted on the beam for pivotable movement about the beam from a generally horizontal seating position to a generally upright non-seating position.

25 Claims, 12 Drawing Sheets

(56) References Cited

FOREIGN PATENT DOCUMENTS

| | | | |
|---|---|---|---|
| GB | 2302562 | A | 1/1997 |
| WO | 9849924 | A1 | 11/1998 |
| WO | 2005069799 | A2 | 8/2005 |
| WO | 2006029473 | A1 | 3/2006 |

* cited by examiner

SEATING

TECHNICAL FIELD

The present invention relates to seating, and more particularly to seating for use in stadia, auditoria and the like.

BACKGROUND

Stadium seating generally takes one of two forms. The simplest form is a seat having fixed seat and back portions, the seat being fixed to a suitable mounting. More commonly, however, for reasons of ease of access, the seat normally comprises a fixed back and a pivotally mounted seat. Typically seats are individually fixed to the stadium structure or fixed to both the adjacent seat and the stadium structure, or a plurality of seats is mounted to a mounting beam which is secured to the stadium structure by stanchions. Generally the seats are pre-assembled off-site and are mounted to the beam as a unit.

BRIEF SUMMARY

The present invention seeks to provide an alternative seating arrangement and from a first aspect provides a seating arrangement for stadia and the like, the arrangement comprising:

a beam for receiving one or a plurality of seats; and at least one seat, said seat comprising:

a backrest portion fixedly mounted to said beam; and a seat portion mounted for pivotal movement about said beam from a seating position to non-seating position.

In accordance with the invention, therefore, rather than rotating about a shaft or axis which is displaced from the beam, the seat now pivots about the beam itself, leading to a simpler, more compact construction.

In preferred embodiments of the invention, the seat portion extends at least partially around the beam. In one embodiment, the seat portion may be provided with one or more pairs of arms preferably defining generally U-shaped slots which will allow the seat portion to be slotted into position over the beam.

The seat is preferably retained on the beam by one or more mounts extending around the beam. Preferably mounts are provided on either side of the seat.

In the preferred embodiment, each mount is provided in two parts, namely a base part which is attached to or integrally formed with the backrest portion and a clamp part, with the beam being clamped between the base part and the clamp part.

From a further aspect the invention provides a seat for assembly to a beam, said seat comprising:

a backrest portion comprising a base part for mounting to said beam;

a seat portion mountable for pivotal movement about said beam;

and a clamp part for clamping said beam between said base part and said clamp part, said seat portion thereby being retained on said beam.

From a yet further aspect the invention provides a seat for assembly to a beam, said seat comprising:

a seat portion mountable for pivotal movement about said beam a mount of or for a backrest, said mount comprising parts for assembly around said beam for retaining said seat portion on said beam.

The base part and clamp part may have means for locating the parts relative to one another. In some embodiments these means may be formed integrally with one or other of the parts, but in others the means may be formed separately from and mounted to one or other of the parts.

The beam preferably includes means for locating the mount and thus preferably the backrest portion of the seat in the correct orientation.

Such locating means may vary in construction, depending on the shape of the beam. The locating means may for example comprise one or more recesses in the beam for receiving complementary projecting locators provided on the support, or vice versa. Preferably, however, the locating means comprises one or more grooves extending along the beam.

In the preferred embodiment, locating grooves are provided along opposed faces, preferably side faces, of the beam and the locators provided on the support comprise one or ribs or blocks for engagement with groove or grooves.

Preferably the faces of the beam incorporating the locating grooves are formed as parallel, flat surfaces. This facilitates installation of the seat over the beam and also provides flat clamping surfaces for the support, to allow for effective clamping of the beam between the parts.

Preferably one or more mounts may comprise stop means for limiting the pivotal movement of the seat portion. One or more stops may be provided not only for limiting the downward pivoting of the seat portion into its seating position, but also for limiting the upward movement of the seat portion to prevent it engaging with the backrest portion.

In some embodiments stops may be provided in oppositely facing pairs so as to distribute the load transfer into the mount from the seat portion, which may be significant when the seat portion is in use. However a single stop in each pivotal direction may be provided. In the preferred embodiment of mount described above, a downward pivoting stop may be provided on one or each of the base part and the clamp part.

The seat portion is preferably provided with lugs or pins which project into the mount(s) for engagement with the stop(s). These lugs or pins may be formed integrally with the seat portion, or for ease of manufacture and for strength reasons separately manufactured and suitably attached to the seat. Of course, it may be possible (installation allowing) instead to provide a projecting part on the mount, rather than on the seat portion, for reception by the seat portion.

In certain embodiments of the invention, the seat portion may rotate directly on the beam. This is advantageous in that it transmits forces directly into the beam rather than through the mount.

Thus the beam may be provided with one or more bearing surfaces for pivotally receiving one or more bearing surfaces provided on the seat portion. Most simply the beam may have a radiused upper surface, for example a constant radius upper surface for engagement with the seat portion.

The seat portion is preferably provided with one or more radiused, preferably constant radius, bearing surfaces for engagement with the beam. The bearing surfaces are preferably provided in bearing blocks arranged at either side of the seat portion.

The seat bearing surfaces are preferably formed with a radius of curvature substantially equal to that of the beam bearing surface to allow contact over a relatively large area of the beam.

In preferred embodiments, particularly but not exclusively when the seat is intended for mounting on a longitudinally curved beam, a portion of the bearing block(s) adjacent the bearing surface(s) may be formed so as to flare away from the bearing surface, for example frustoconically, so as to accommodate a curved beam. Preferably the flared portion is arranged inwardly of the bearing surface. Alternatively, the adjacent portion may be relieved in some other way to provide the requisite clearance, for example by a step.

In other embodiments, however, the seat portion does not actually rotate on the beam but on the mount(s). In particular, one or more bearing surfaces may be provided on the mount(s) for engagement with bearing surface(s) provided on the seat portion. Guide means, for example in the form of an arcuate guide, recess or track, may be provided for receiving the seat lug or pin. This guide or track may act as the bearing surface for the seat portion, for example the lug or pin. A possible advantage of having the seat rotate on the mount is that it can potentially easily accommodate the mounting of the seat on a longitudinally curved beam.

The mount(s) provided on or attached to the backrest portion, also preferably comprise an arcuate upper surface for engaging over the curved portion of the beam. The effective radius of curvature of the mount(s) is also preferably greater than that of the beam such that it may accommodate a longitudinally curved beam.

The mount(s) or seat portion may also be provided with damping means for damping the upward rotation of the seat portion towards the end of its travel. In a simple embodiment, a spring, for example a bow spring, is mounted on one or other of the parts, for example the mount, so as to contact the other part when the seat is approaching its vertical position.

The mount(s) or seat portions may also be provided with spring means to provide an initial impetus for the upward rotation of the seat portion. The spring means may advantageously be provided in a stop surface of the mount.

The beam is preferably mounted to a stanchion with one or more brackets The stanchion may be fixedly or adjustably mounted to a support structure. An adjustable mounting may allow the position of the stanchion to be adjusted such that it does not interfere with the seat mounting.

The invention also extends to a method of installing a seat on a beam comprising the steps of:

locating a seat portion pivotally about the beam, said seat having stop means for limiting pivotal movement thereof; and assembling a mount to said beam so as to capture said stop means within the mount.

The details of the seat portion and the backrest portion may be as described above.

BRIEF DESCRIPTION OF THE DRAWINGS

Two preferred embodiments of the present invention will now be described by way of example only with reference to.

DETAILED DESCRIPTION

Figure 1:
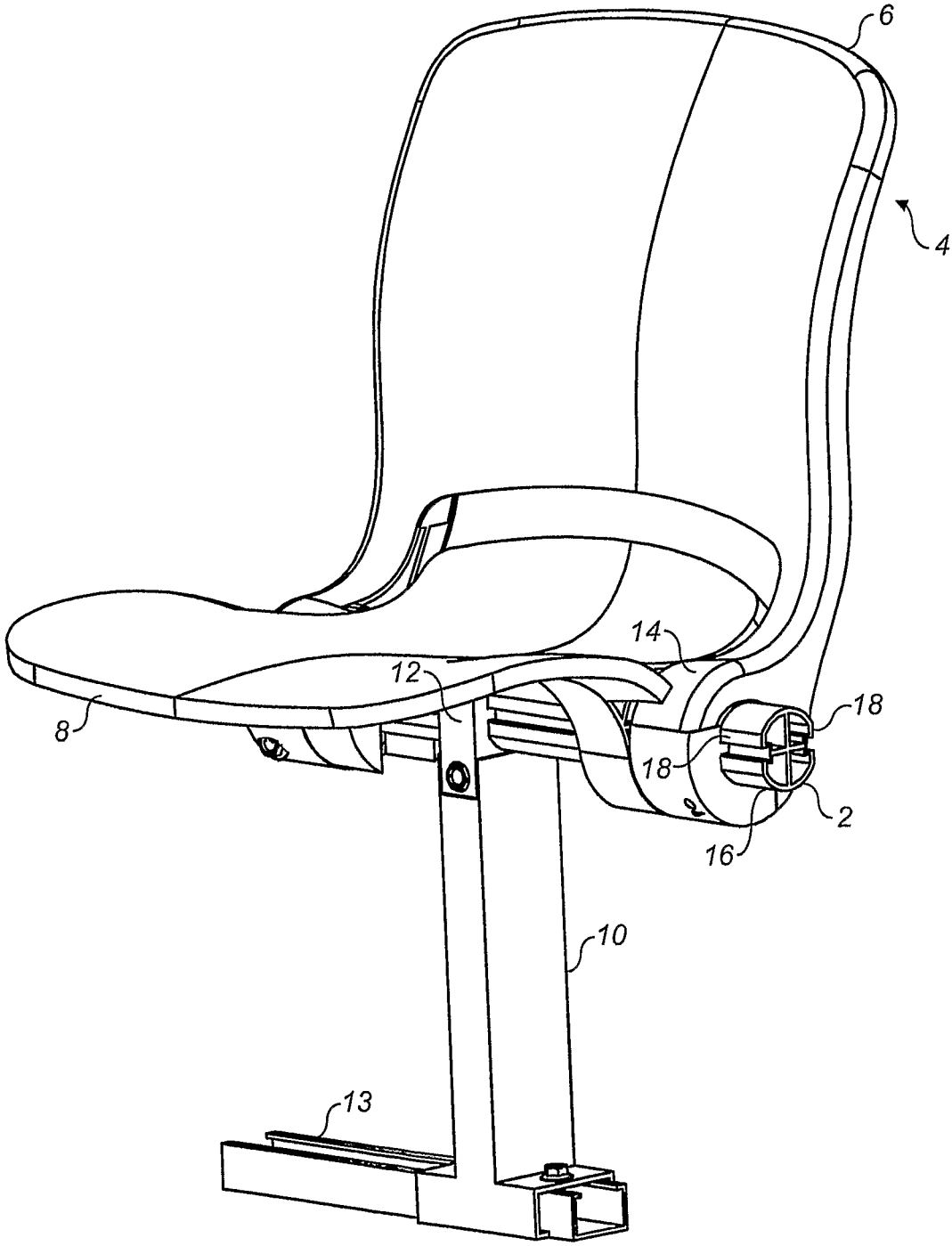
FIG. 1 is a perspective view of a seating arrangement in accordance with the present invention.
Figure 2:
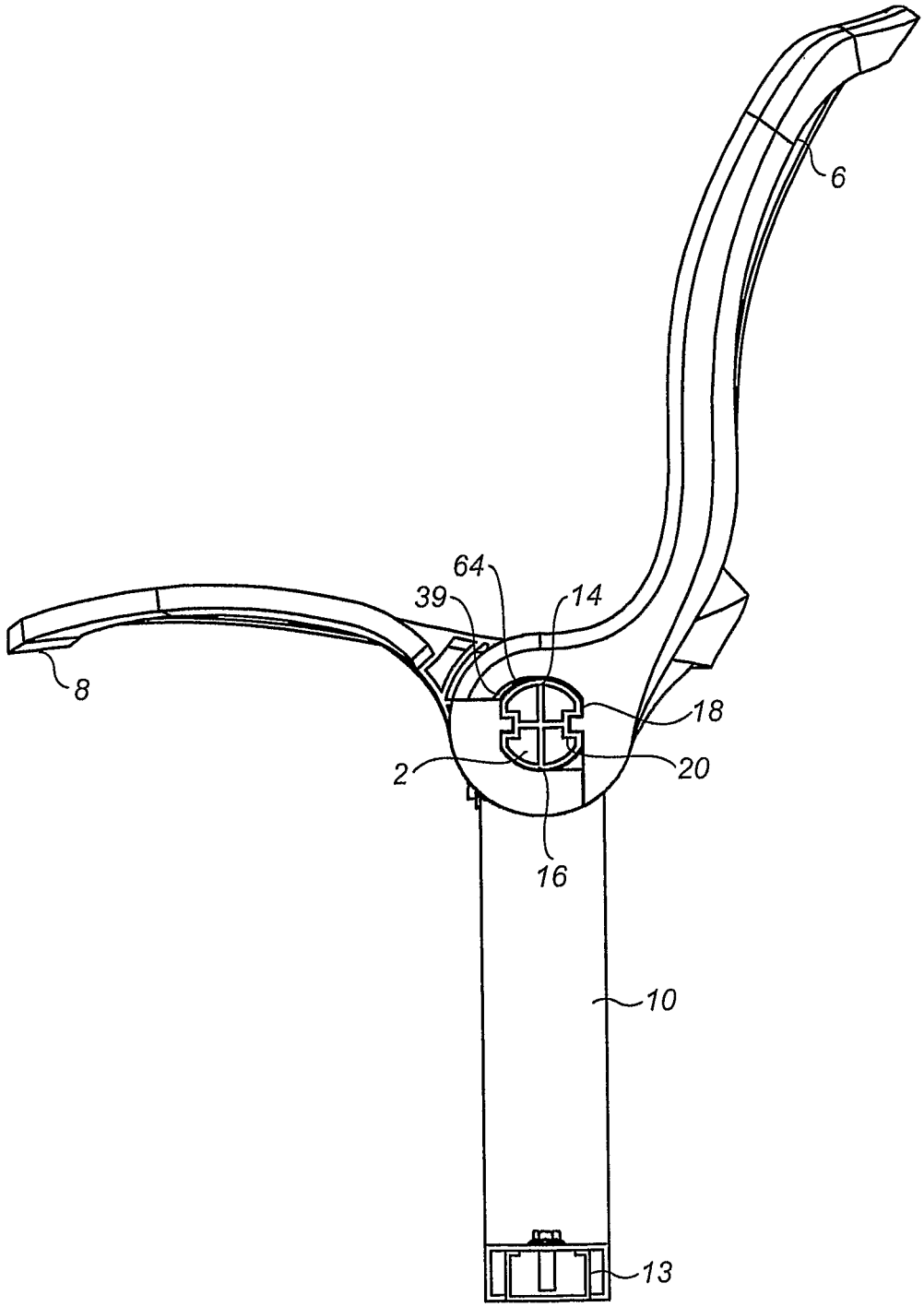
FIG. 2 is an end view of FIG. 1.
Figure 3:
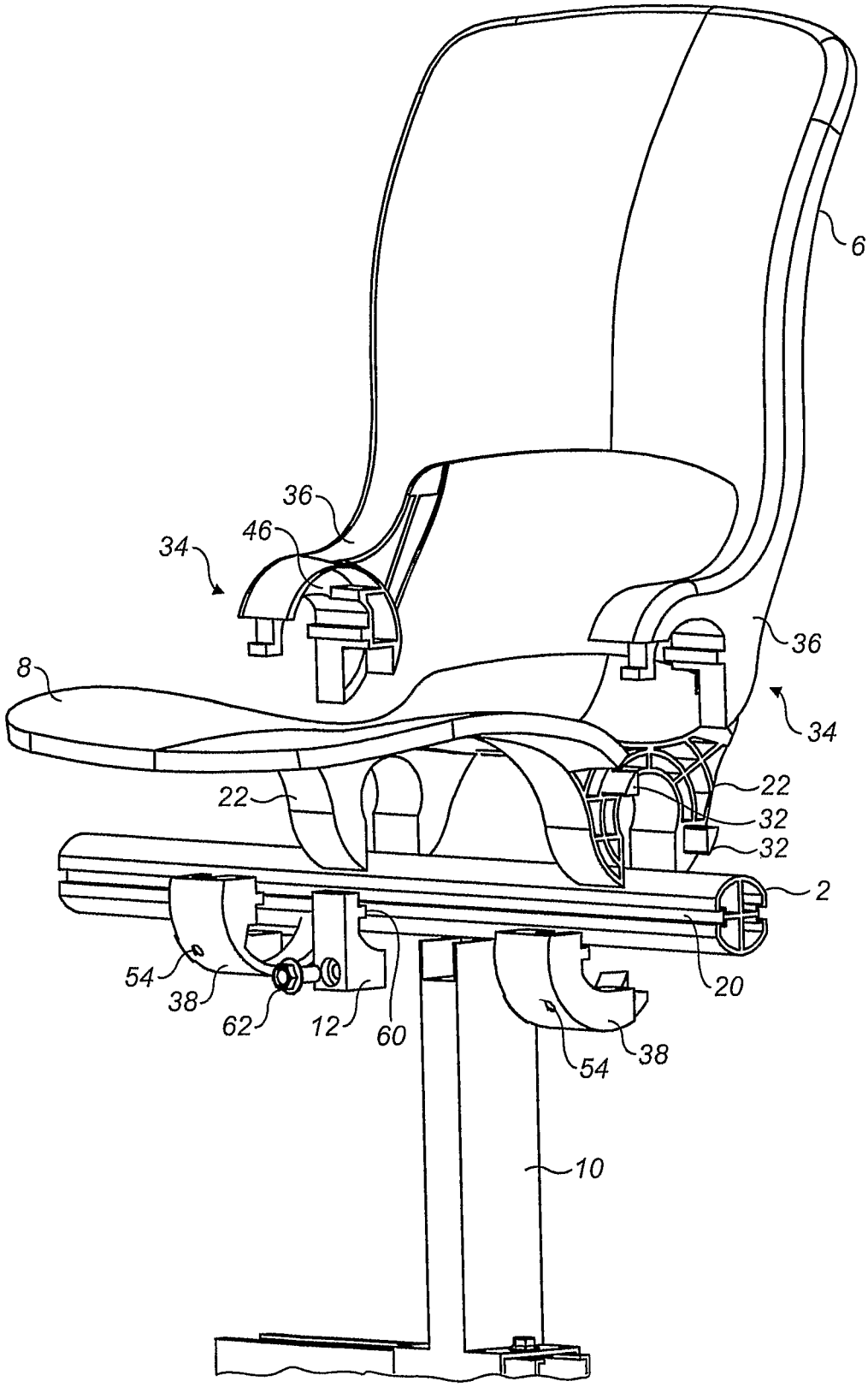
FIG. 3 is an exploded perspective view of the arrangement of FIG. 1.

With reference to FIG. 1, a seating arrangement in accordance with the present invention comprises a beam 2 and a seat 4 comprising a backrest portion 6 and a seat portion 8. In this embodiment, both portions are moulded plastics components, although other materials may be used as appropriate.

As will be described further below, the backrest portion 6 is fixedly mounted to the beam 2 while the seat portion 8 is pivotally mounted about the beam 2 for movement between the generally horizontal seating position shown and a generally vertical non-seating position. The beam 2 is supported on one or more spaced apart stanchions 10 by brackets 12. The stanchion 10 is adjustable in position on the beam 2 so that it can be moved to a position in which it does not interfere with the seat mounting. This is made possible by the stanchion 10 being mounted in an adjustable position along a rail 13 which is fixed to the stadium or other structure.

The beam 2 has upper and lower arcuate or circular surfaces 14,16 and planar sides 18. The planar sides 18 are provided with opposed elongate grooves 20.

Figure 4:
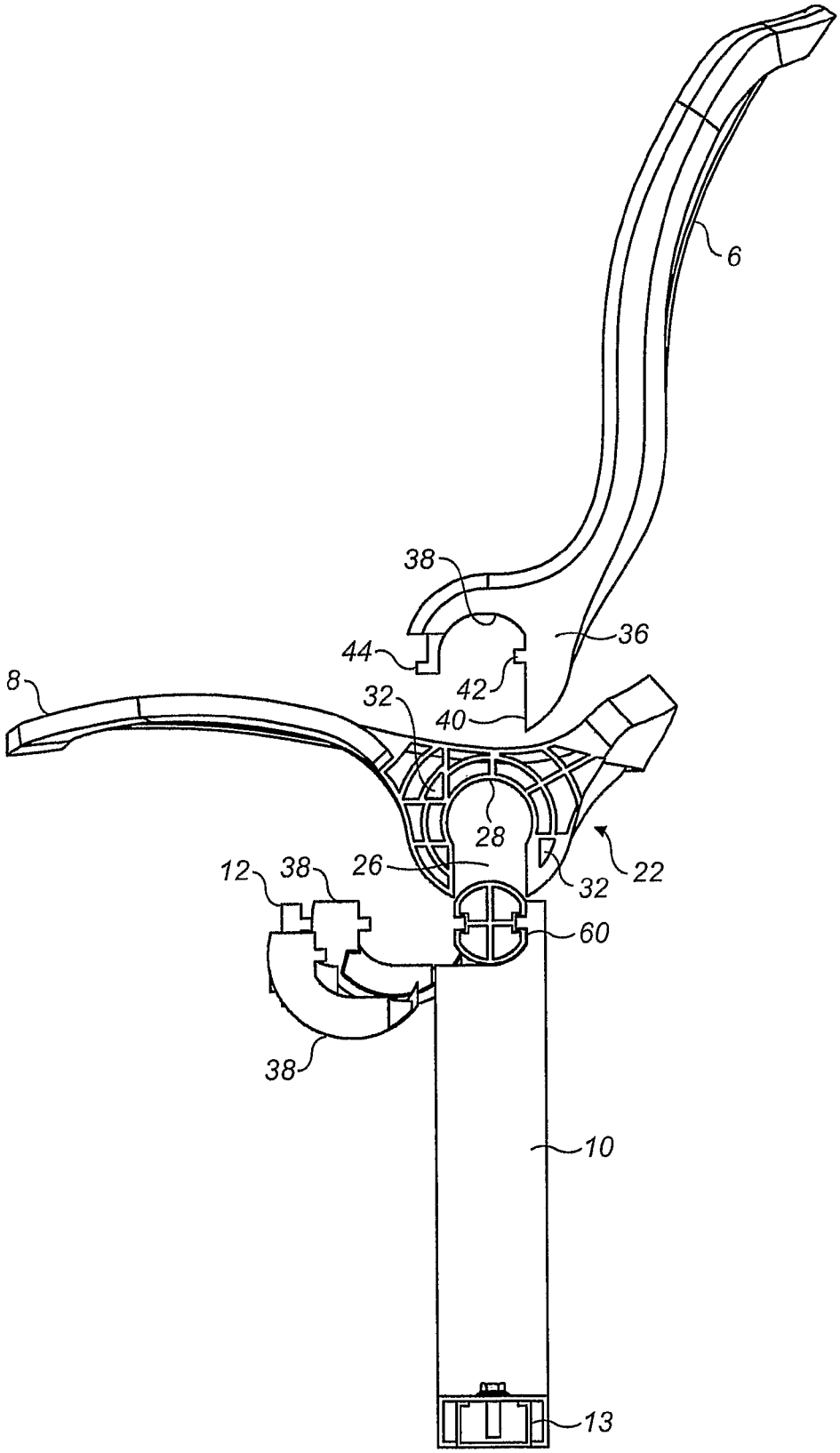
FIG. 4 is an exploded view of FIG. 2.

The seat portion 8 comprises spaced apart, mirror image mountings 22 at its respective sides. Each mounting 22 comprises a inverted generally U-shaped slot 26. As will be seen from FIG. 4, the inverted U-shape will allow the seat portion 8 to be slotted over the beam 2 during assembly.

The upper surface 28 of each slot 26 is generally circular and is spaced from the arcuate surfaces 14 of the beam 2 to provide a clearance between the two.

The seat mountings 22 are provided with aligned, generally triangular openings which receive stop pins 32 which project outwardly from the seat mountings 22. The pins 32 may also be of plastics, for example glass filled nylon or of metal and preferably assembled by an interference fit in the openings.

The backrest portion 6 is formed with mirror image mounts 34 at each lower corner. Each mount 34 is formed in two parts, namely a base part 36 which is integral with the backrest portion 6 and a clamp part 38. The clamp part 38 is also preferably a moulded plastics component. The base part 36 has a U-shaped channel 30 for engagement over the upper surface 14 of the beam 2. It further comprises a planar clamping surface 40 for engagement with a side face 18 of the beam 2 and a rib 42 for engagement within the groove 20 in that side face 18 of the beam. The base part 36 also includes a forwardly facing hook 44 and an inwardly facing arcuate recess 46.

Figure 5:
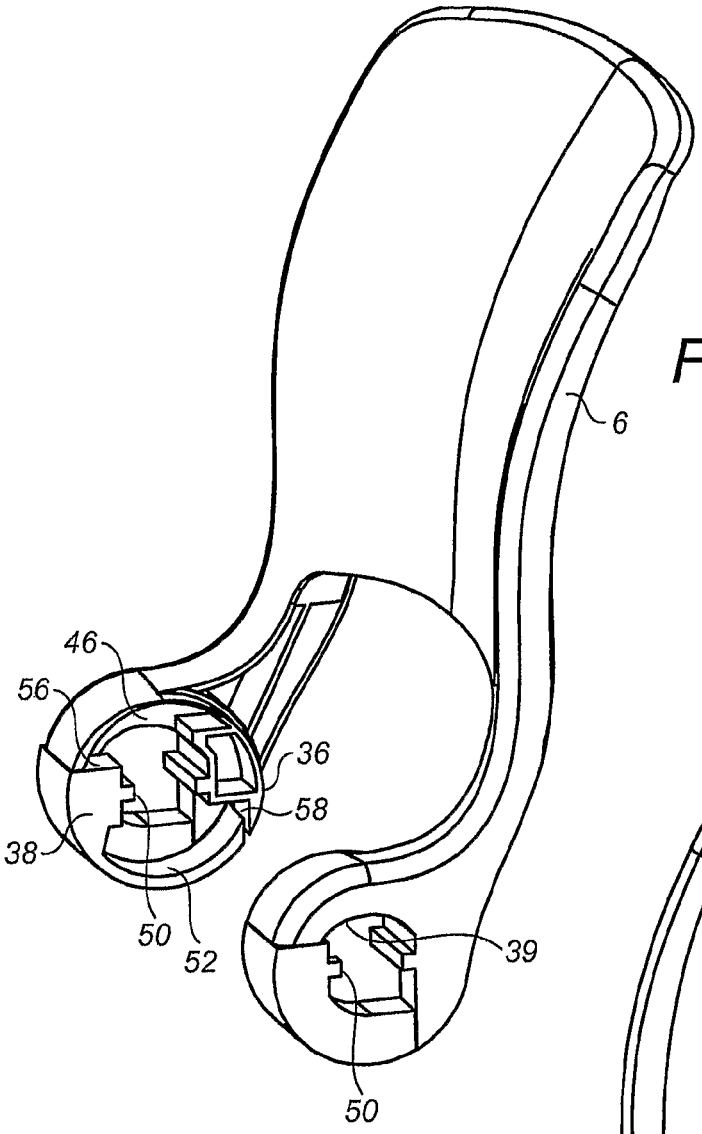
FIG. 5 is a first perspective view of a detail of the seat shown in FIG. 1.
Figure 6:
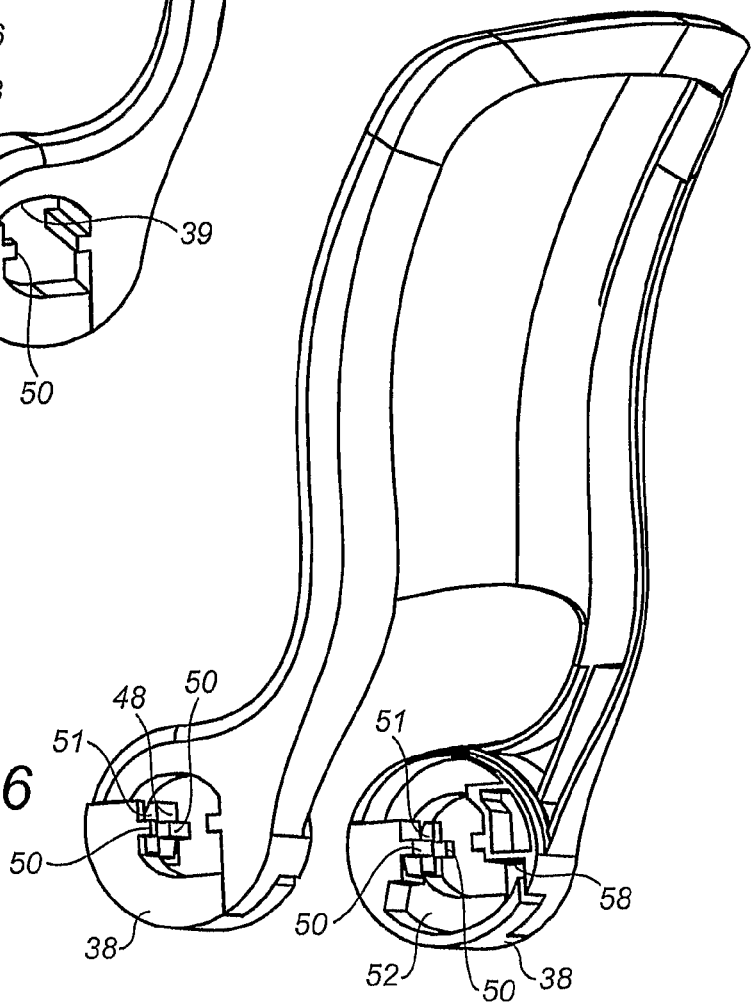
FIG. 6 is a further perspective view of the detail

As can be seen most clearly from FIGS. 5 and 6, the clamp part 38 comprises a pair of co-planar surfaces 48 each having an aligned rib or block 50. A stepped recess 51 is provided between the surfaces 48 in order to receive the hook 34 of the base 36. The clamp part 38 also comprises an inwardly facing arcuate recess 52.

Each clamp part 38 is mounted to the corresponding base part 36 by a fixing e.g. a screw or bolt (not shown) which extends through openings 54 formed in the clamp part 38 into the base part 36. It will be seen from FIG. 5 that when the two mount parts 36, 38 are assembled, a top surface 56 of the clamp part 38 forms a stop surface at one end of the base recess 46 and that a recessed surface 58 in the base part 36 forms a stop surface at one end of the clamp recess 52. When the seat is fully assembled, the pins 32 projecting from the seat mountings 22 are received within the recesses 46,52. Flat surfaces of the pins 32 will engage the respective stop surfaces 56,58 when the seat is in its lowered position, thereby stopping the seat in its lowered position. The pins 32 will engage the other ends of the respective recesses 46, 52 when the seat is in its upright position, preventing excess rearward pivoting of the seat. It will be appreciated that the arcuate inner surfaces of the recesses 46, 52 will act to guide and retain the pins 32, preventing excessive play in the seat portion 8. The arcuate inner surfaces of the recesses 46, 52 act as bearing surfaces for the curved outwardly facing surfaces of the pins 32.

Due to the clearance between the seat slot surface 28 and the beam, curved beams can be accommodated. The mounts 34 also accommodate such beams. In particular the effective radius of the backrest channel surface 39 is greater than that of the upper surface 14 of the beam 2. The rear and front portions of the backrest channel surface 39 have a radius of curvature substantially similar to that of the beam upper surface 14, but with a flatter, almost linear central section. This leaves a small gap 64 between the backrest part and the beam 2. This gap 64 will accommodate beam curvature between the respective end mounts 34. The backrest portion 6 will however still be clamped firmly in position by the clamp parts 38.

Installation and assembly of the seating arrangement described above will now be explained.

The beam 2 is mounted to the stanchion 10 by the stanchion brackets 12, one of which is formed integrally on the stanchion 10. These brackets 12 include hooks 60 engaging with the grooves 20 in the beam. The brackets 12 are held together by a fastener 62. The position of the stanchion 10 can be adjusted on the beam 2 so as to prevent any interference between the stanchion 10 and the seat mounting. In practice, the stanchions 10 may be bolted down first, the beam 2 then mounted to the stanchion and the seats finally located on the beam 2

As a next step in the installation procedure, the seat portion 8 is slotted over the beam 2. The backrest portion 6 may then be dropped into position on the beam 2 and the ribs 42 inserted into the groove 20 in the beam. The clamp parts 38 may then be engaged around the lower part of the beam 2 with the ribs or blocks 50 engaging the groove 20 in the beam 2 and the recess 52 receiving the hook 44 of the base part 36 of the backrest 6. During this assembly, the pins 32 of the seat mountings 22 are captured between the mount parts 36, 38 so as to lie in the respective recesses 46,52 in the base part 36 and the clamp part 38. The clamp part 38 can then be tightly fastened to the base part 36 in order firmly to clamp the backrest portion 6 in position.

With this arrangement, the backrest 6 is firmly supported on the beam 2. The beam 2 also takes the weight of the seat portion 8 and its user through the mounts 34 as the seat portion 8 rotates in the mounts 34 rather than on the beam 2. The lateral movement of the seat portion is constrained by the mounts 34 and its pivotal movement is limited by the stops provided in the recesses 46,52 in the mounts 34.

The seat portion 8 may be weighted at its back or spring loaded in order allow it to pivot upwardly when not in use. Alternatively, the seat 8 may simply be pivoted upwardly by a user when he or she wishes to pass.

The above description is of just one embodiment of the invention and the reader will appreciate that modifications to the embodiment may be made within the scope of the invention. For example, the seat portion 8 may be arranged to rotate directly on the beam 2, particularly if a straight beam 2 is being used. Also, the stanchion 10 can be fixedly, rather than adjustably, mounted to the underlying structure if a simpler construction is required. In a further embodiment, the backrest portion 6 need not be integrally formed with the base part 36, but suitably attached thereto.

A further embodiment of the invention is illustrated in FIGS. 7 to 15. In this embodiment, the seat portion is arranged to rotate directly on the beam, but the arrangement is such that the seat portion can be mounted on a curved beam. The various components of the second embodiment are made from the same materials as those of the first embodiment.

Figure 7:
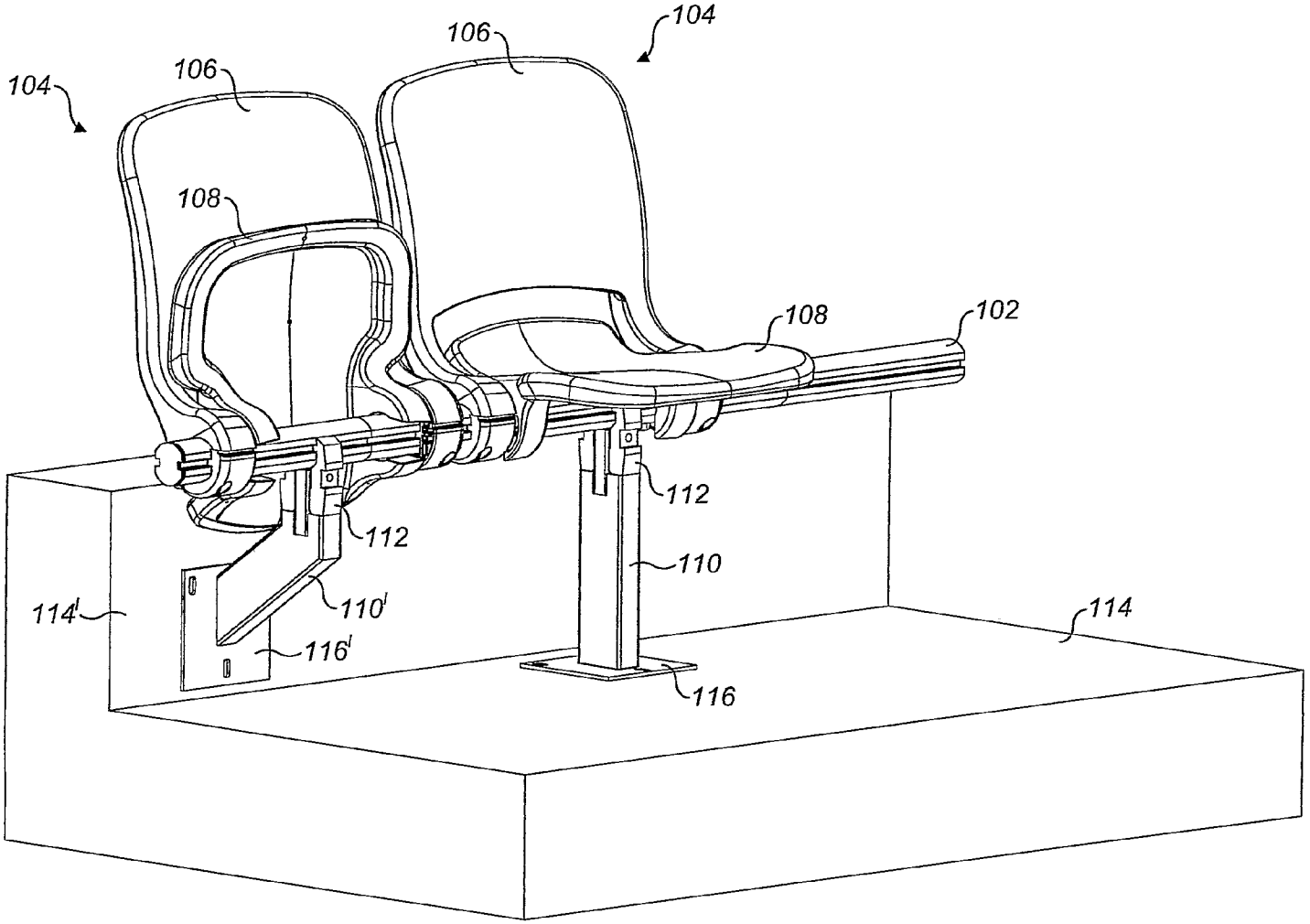
FIG. 7 shows a second embodiment of the invention.
Figure 8:
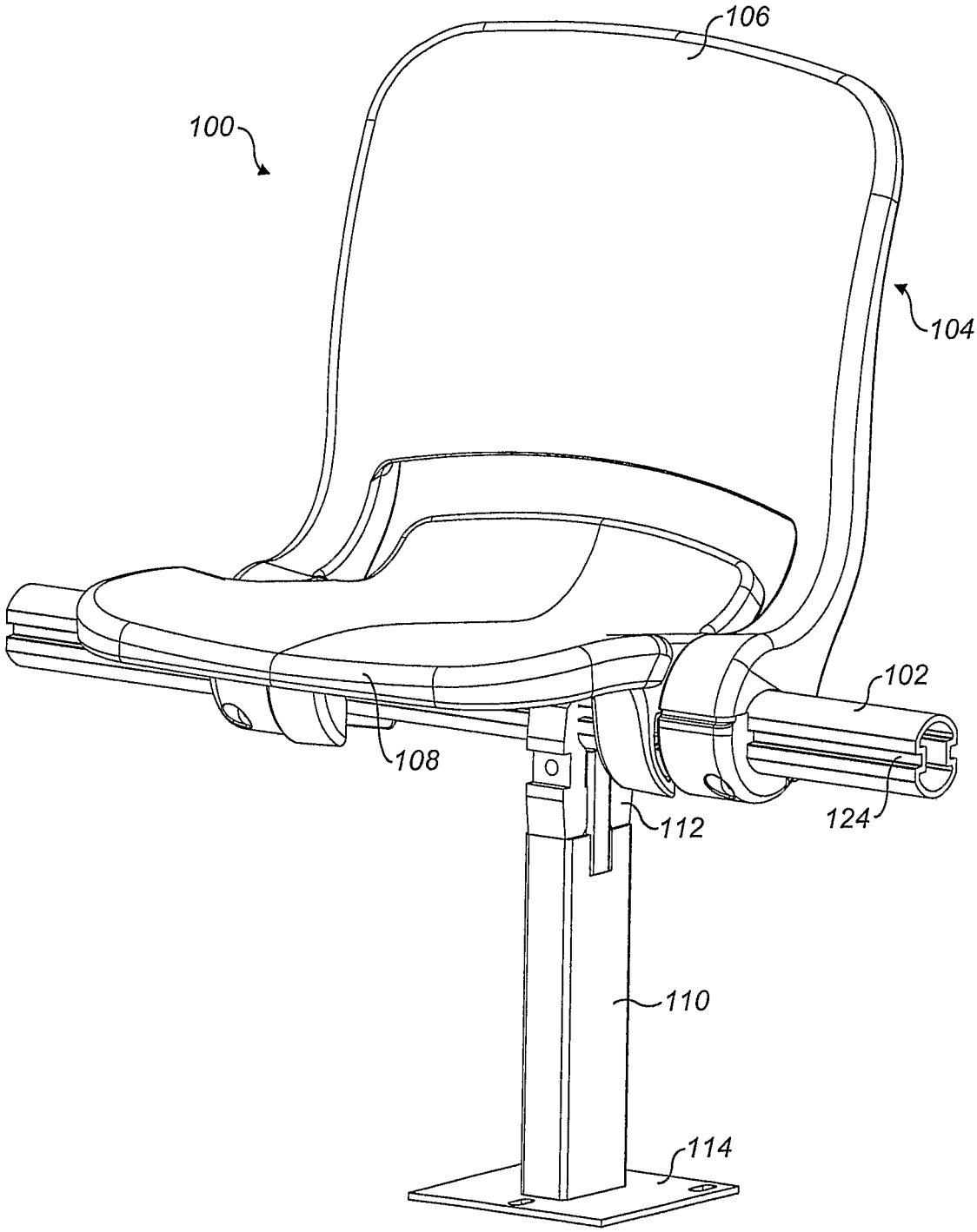
FIG. 8 shows a detail of one of the seats of FIG. 7.

As shown for example in FIGS. 7 and 8, a further seating arrangement 100 comprises a beam 102 and a seat 104 which comprises a back rest portion 106 and a seat portion 108. As in the earlier embodiment, the back rest portion 106 is fixedly mounted to the beam 102 while the seat portion 108 is pivotally mounted about the beam 102.

Also as in the earlier embodiment, the beam 102 is supported on one or more spaced apart stanchions 110, 110' by mounting brackets 112. In this embodiment, unlike the earlier embodiment, the stanchions 110, 110' are attached to a support surface 114, 114' by means of a mounting plate 116, 116'. As can be seen in FIG. 7, the support surface 116, 116' may be horizontal or vertical for example. However, an adjustable mounting mechanism may also be provided as in the earlier embodiment.

The beam 102 is the same in this embodiment as in the earlier embodiment, having upper and lower arcuate surfaces 118, 120 and planar opposed side surfaces 122 each having an elongate groove 124. For ease of assembly, the grooves 124 are flared slightly towards the surfaces 122 (as indeed may be the grooves of the earlier embodiment).

The seat portion 108 may have a moulded-in counterweight at its back to move the seat portion 108 to an upright position when not in use.

Figure 10:
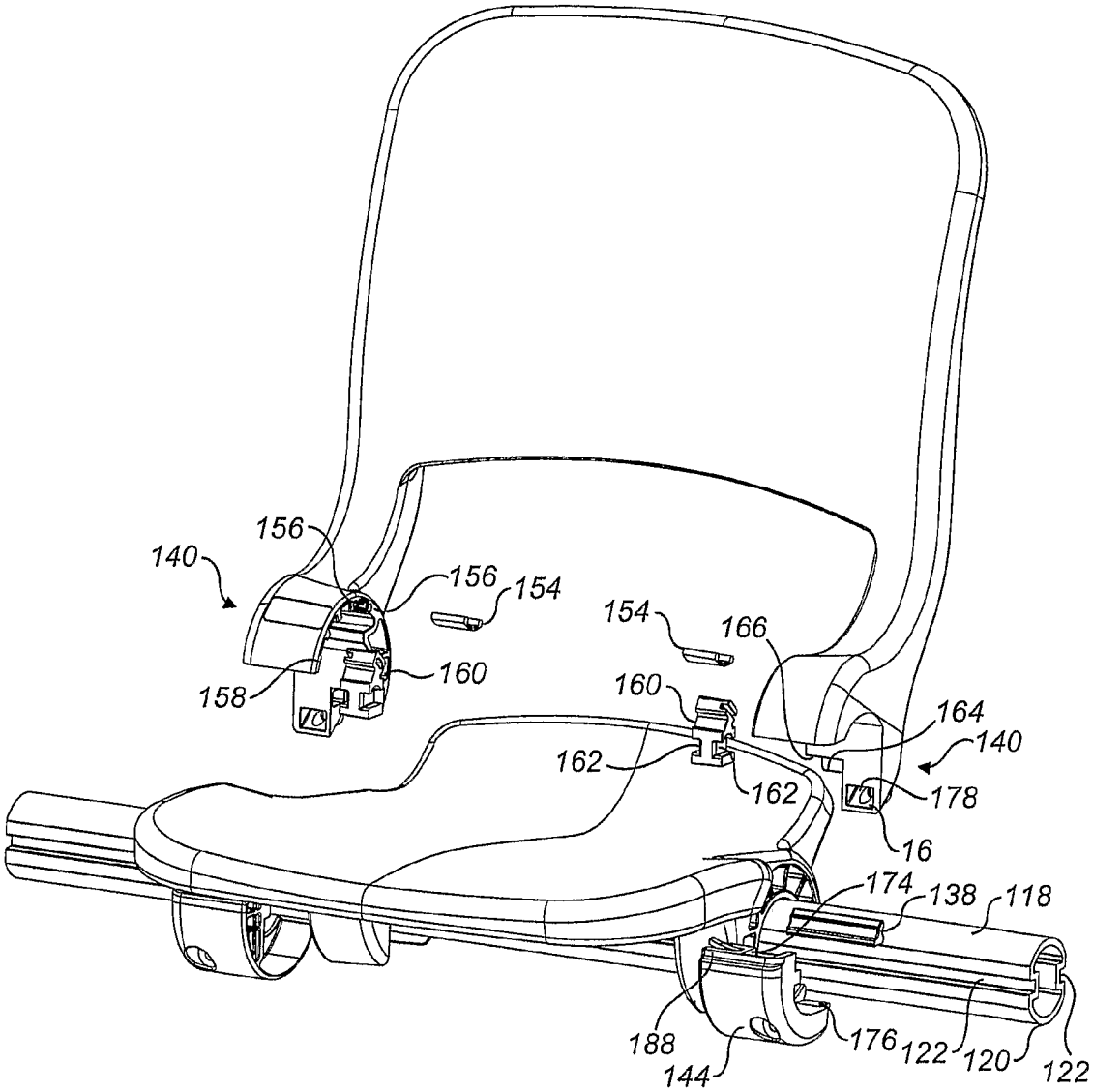
FIG. 10 shows and exploded view of the seat of FIG. 7.
Figure 11:
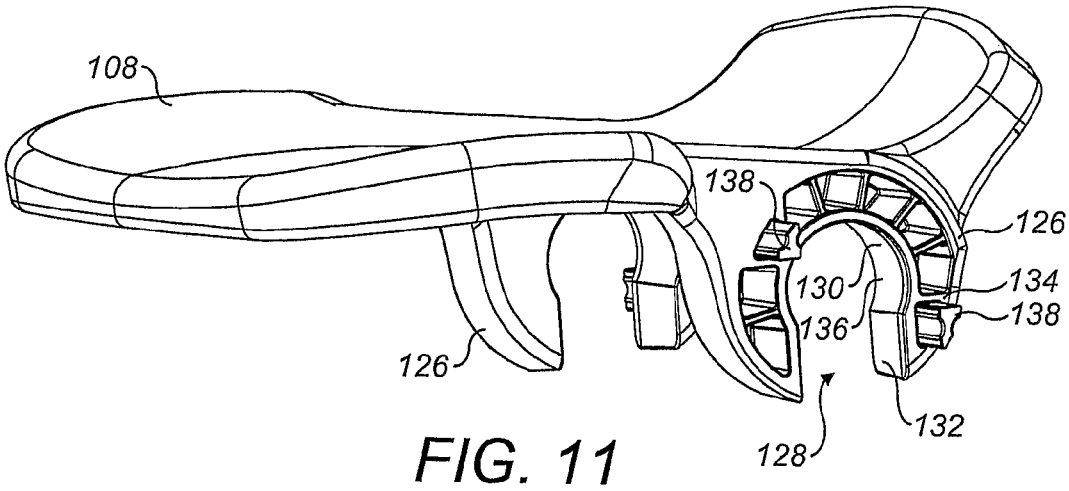
FIG. 11 shows a perspective view of the seat portion of the seat of FIG. 7.
Figure 12:
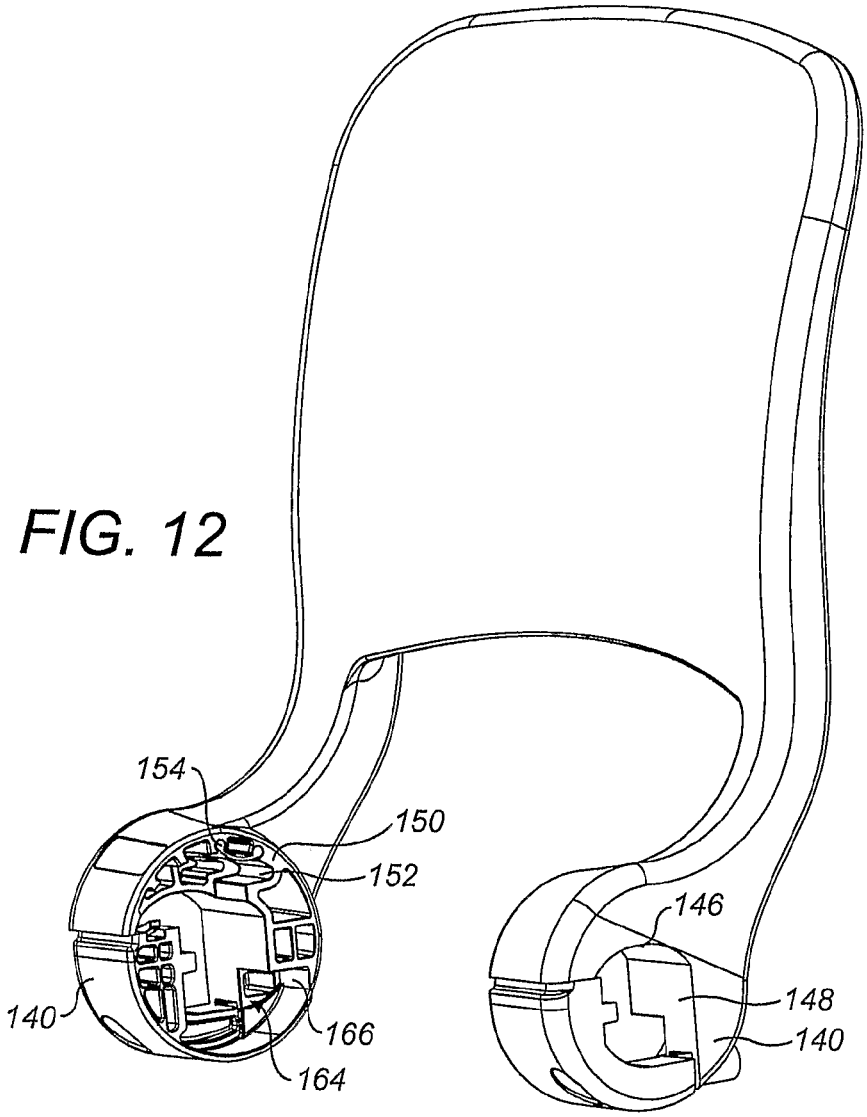
FIG. 12 shows a first perspective view of the backrest portion of the seat of FIG. 7.

As can be seen in FIG. 10, the seat portion 108 comprises spaced part, mirror image mounting blocks 126 at either side. As in the earlier embodiment, each mounting block 126 comprises an inverted generally U-shaped slot 128 which allows the seat portion 108 to be slotted over the beam 102 during assembly.

The slot 128 has an upper surface portion 130 and a lower portion 132. The upper portion 130 has a relatively narrow (e.g. about 5 mm wide) curved part-cylindrical laterally outer portion 134 and a flaring, preferably frustoconical section laterally inner portion 136 The radius of curvature of the part cylindrical portion 134 is substantially the same as or just slightly greater than that of the beam 102. In practice the parts will preferably be constructed such that in a maximum adverse tolerance situation the radii will be the same to prevent seat binding on the beam. The frustoconical portion 136 accommodates curvature in the beam 102, when the seat portion 108 is mounted on the beam 102, as shown in FIG. 15.

As in the earlier embodiment, the seat mountings 126 are also provided with generally triangular openings which receive stop pins 138 which, as in the earlier embodiment may also be of a plastics material or a metal material and assembled by interference fit in the seat mounting.

Thus the seat portion 108 of this embodiment is generally similar to that of the seat portion 8 of the earlier embodiment apart from the seat mountings 126 having frustoconical portions 136 and the radius of curvature of the bearing portions being smaller relative to those of the earlier embodiment which do not engage the beam but are spaced from it.

As in the earlier embodiment, the back rest portion 106 is formed with mirror image mounts 140. Each mount 140 comprises a base part 142 integral with or suitably attached to the back rest portion 106 and a clamp part 144. These may be of the same materials as in the first embodiment.

The base part 142 has a U-shaped channel 146 for engagement over the upper surface 118 of the beam 102. It also comprises a planar clamping surface 148 for engagement with a side face 122 of the beam 102. Unlike the earlier embodiment, however, this surface 148 it not provided with a mounting rib as this is found to facilitate installation.

The base part 142 also includes a recess 150 on its inwardly facing upper part which is formed with a stop surface 152 at one end. The recess 150 accommodates a bowed leaf spring 154 which is received in slots 156. The base part 142 also incorporates a slot 158 which receives a locating block 160. This block 160 performs the same function as the forwardly facing hook of the earlier embodiment but is provided as a separate component to facilitate manufacture and also to provide the possibility of making this component (which in use may be highly stressed) from a different material from the rest of the mount. Each block 160 has a pair of opposed grooves 162 for engaging with the clamp part 144. A grooved block arrangement, rather than a hook is found to be advantageous in transmitting forces between the parts.

A step 164 is provided on the base part 166, the upper surface 164 of which acts as a stop surface.

The clamp part 144 includes a clamping surface 168 having projections 170 for engaging in the groove 122 formed in the front surface 122 of the beam 102. As in the earlier embodiment a slot 174 is provided between the projections 170 for receiving the locating block 160, the slot 174 having ribs which engage in the grooves 162 of the locating block 160.

Figure 13:
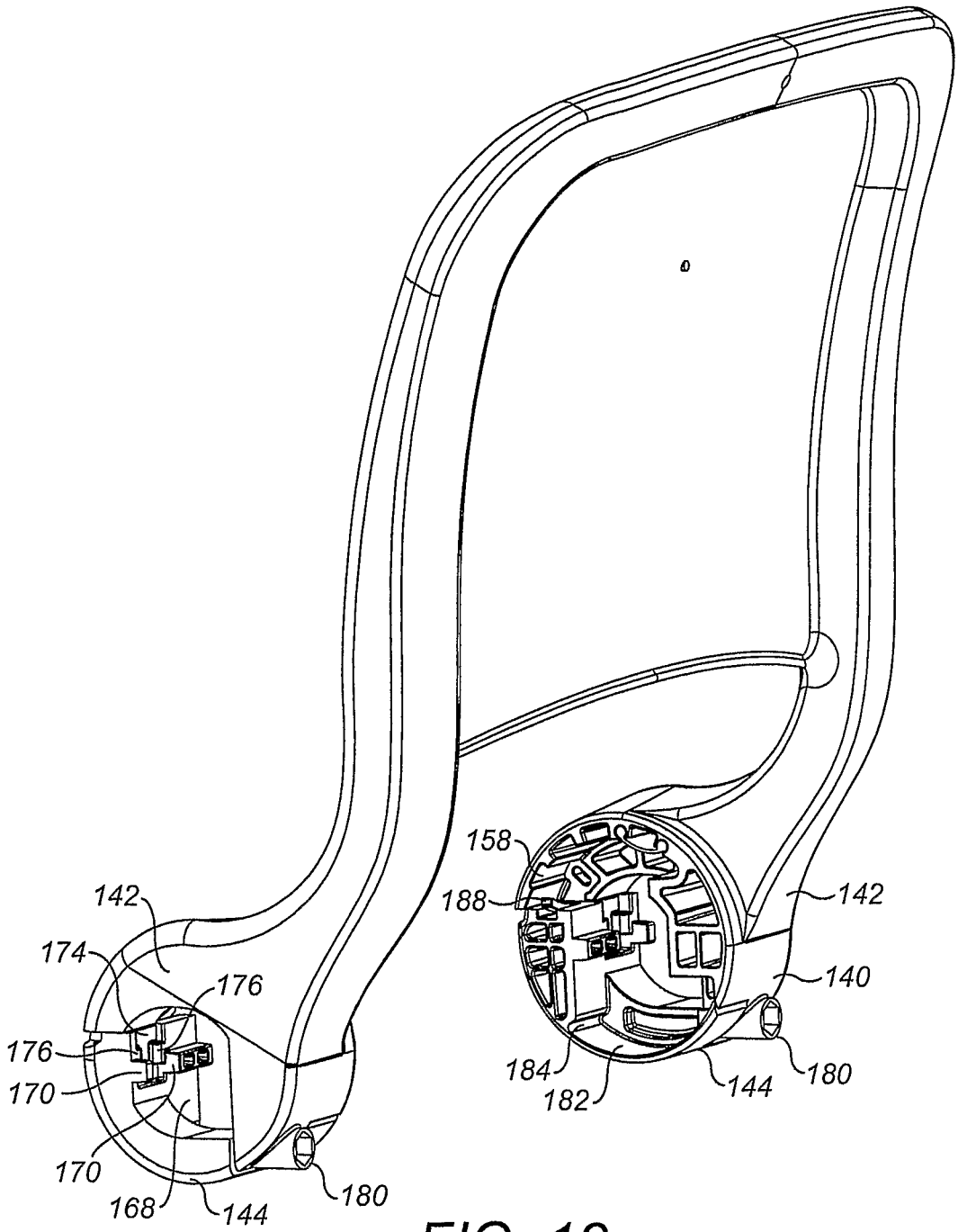
FIG. 13 shows a second perspective view of the backrest portion of the seat of FIG. 7.

A projecting tab 176 is formed on the back of each clamp part for engagement in opening 178 provided in the base part 142 which receives a clamping fastener in an opening 180 as seen best in FIG. 13.

The clamp part 144 also comprises an inwardly facing arcuate recess 182 having a stop 184 formed at one end thereof.

The upper surface 186 of the clamp part 144 is provided with a moulded in spring member 188. When the base part 142 and clamp part 144 are connected together the spring member 188 projects into the recess 150 of the base part 142 so as to engage with the seat portion pin 138.

Figure 9:
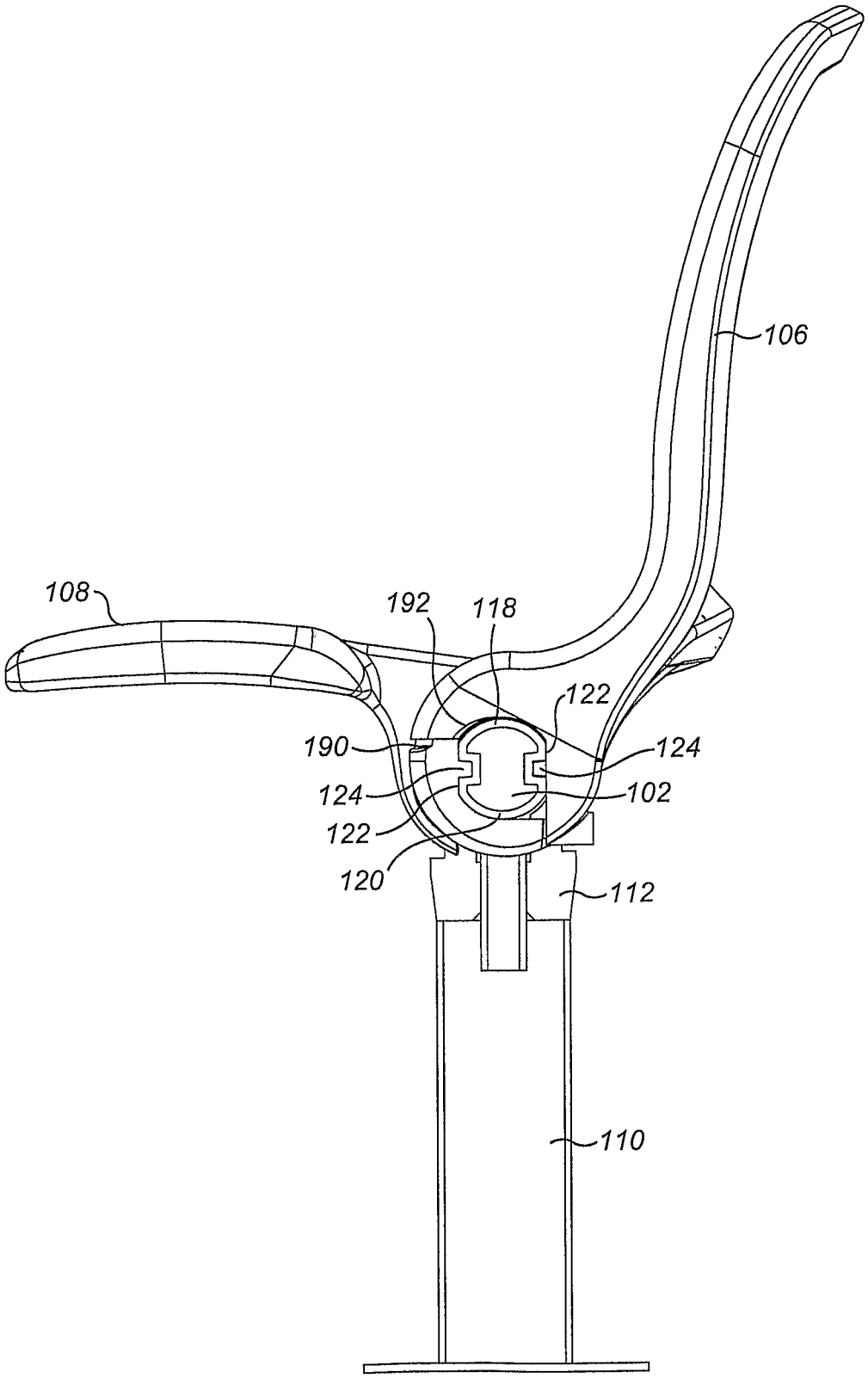
FIG. 9 shows a side view of the seat of FIG. 8.

As will be seen in FIG. 9, the upper end of the clamp part 144 has a recess 190. This is for aesthetic purposes, the outer surface of the clamp part 144 lying flush with the adjacent surface of the base part 142 when the seat 102 is mounted on a curved beam having the minimum design radius of curvature.

To assemble the seat 102 of the second embodiment, the seat portion 108 is assembled over the beam 102. The leaf springs 154 are mounted in the slots 156 of the base part 142 and the locating blocks 160 mounted in the slots 158. The back rest portion 106 is then mounted over the seat portion such that the seat pins 138 of the seat portion received in the recesses 150. The clamp part 144 is then mounted to the base part 142 of the back rest portion 106 such that the grooves 162 of the locating blocks 160 are received over the clamp part ribs 176 and the tabs 176 received in the openings 178.

The parts are clamped to the beam 102 by the mounting bolts. The vertical surface 148 of the back rest portion is firmly located against the rear surface 122 of the beam 102. The projections 170 of the clamp part 144 locate in the groove 124 on the front surface 122 of the beam 102 in order to locate the back rest portion 106 in the appropriate vertical position. The beam 102 is therefore firmly clamped between the vertical surfaces 168, 148 of the clamp part 144 and the base part 142.

Figure 14:
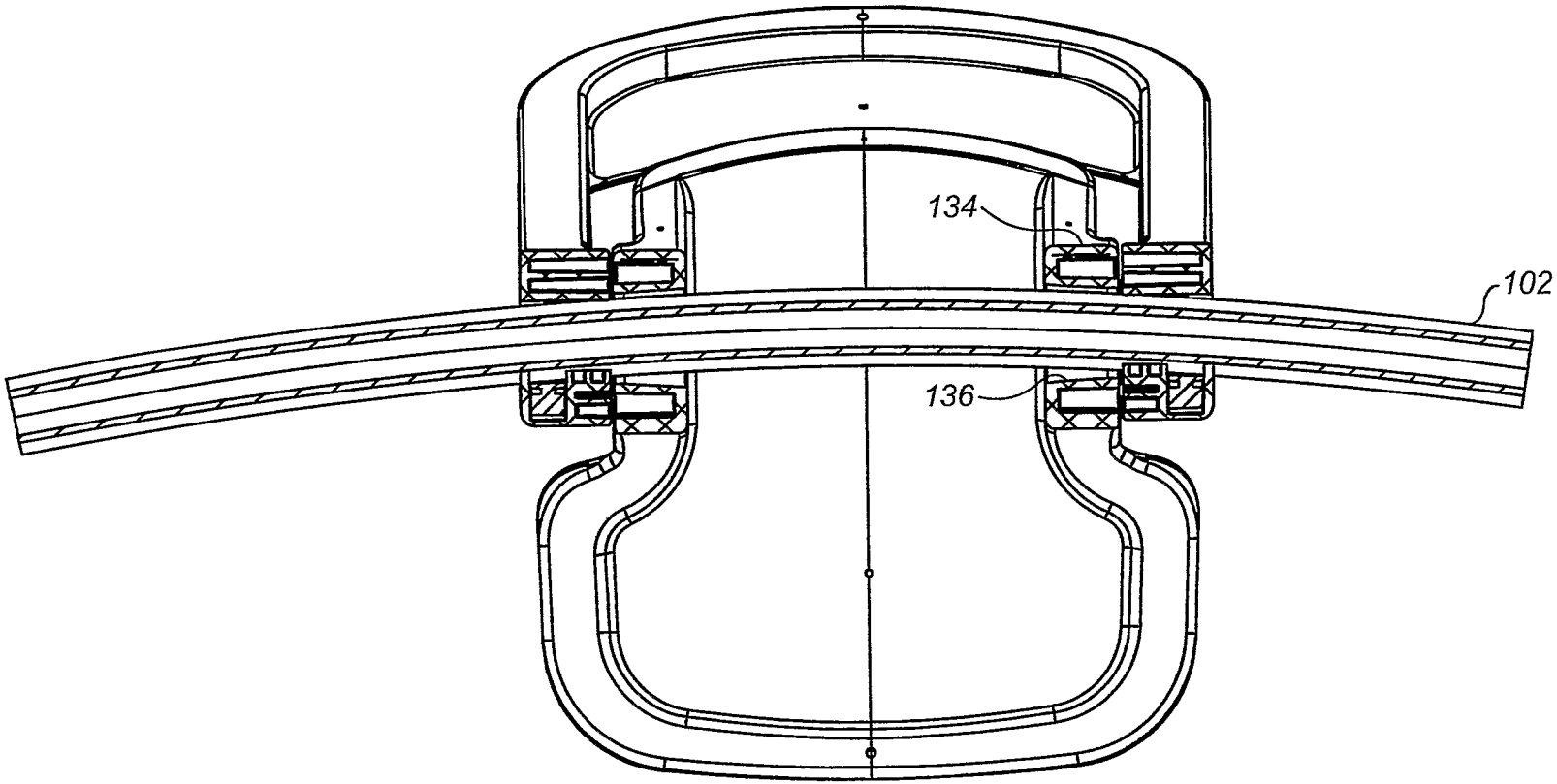
FIG. 14 shows a section through the seat of FIG. 7 along the centreline of the beam grooves.

With a straight beam 102 the clamping will be over a relatively large area as the vertical surfaces 148, 168 are all parallel. If the beam 102 is curved, as shown in FIG. 14, then the clamping will occur only over a smaller area due to the misalignment of these surfaces. However, this will be enough to provide sufficient support for the seat. As in the earlier embodiment, the curvature of the beam 102 is also accommodated by the radius curvature of the upper base part surface 146 being greater than that of the beam, thereby leaving a gap 192 between the beam 102 and the base part 142, as shown in FIG. 9.

The seat portion 108 rests on the upper surface 118 of the beam 102, that surface 118 acting as a bearing surface for the seat portion 108. In fact, the surface 118 engages with the cylindrical surface 134 of the seat mount 122. On a straight beam 102, there is contact between the two surfaces over substantially the entire surface area of the cylindrical surface 134. On a longitudinally curved beam 102, there will be a smaller, but sufficient area of contact between the two parts. The relatively narrow width of the surface 134 accommodates rotation around a curved beam. The seat portion 108 is prevented from lifting from the beam 102 by virtue of the engagement of the pins 138 with the back rest mounts 144.

When the seat portion 108 is in horizontal seating position, for example as shown in FIG. 8 the rear pin 138 engages against the stop surface 166 provided on the base part 142 which limits the downward movement of the seat portion 108. In this position the other pin 138 engages and deflects the spring 188 such that when a user stands up, the spring acts to "kick" the seat portion upwardly. The counterweight continues this movement until the pin 138 engages the bowed leaf spring 154 to damp the movement of the seat portion 108 thereby preventing the seat portion banging into the stop 152 which limits the pivoting of the seat portion 108.

Thus this embodiment of the invention is generally similar to the first embodiment apart from the seat portion 108 being mounted directly on the beam 102.

The invention claimed is:

1. A seating arrangement for stadia and the like, the arrangement comprising:

a beam for receiving one or a plurality of seats; and at least one seat, said seat comprising:

a backrest portion fixedly mounted to said beam; and a seat portion mounted for pivotal movement about said beam from a seating position to non-seating position, wherein said seat portion is retained on said beam by one or more mounts, the or each mount comprising a base part which is attached to or integrally formed with the backrest portion and a clamp part, the beam being clamped between said base part and said clamp part, and wherein said one or more mounts includes an arcuate recess and said seat portion is provided with a lug or a pin, said lug or pin being received within the arcuate recess, the one or more mounts further comprising a stop cooperable with said lug or pin for limiting the pivotal movement of said seat portion.

2. A seating arrangement as claimed in claim 1 wherein said seat portion rotates on said beam, said beam being provided with one or more bearing surfaces for pivotally receiving one or more bearing surfaces provided on the seat portion.

3. A seating arrangement as claimed in claim 2 wherein said beam and seat portion have radiused bearing surfaces.

4. A seating arrangement as claimed in claim 3 wherein said seat portion bearing surface(s) has substantially the same radius as the beam bearing surface(s).

5. A seating arrangement as claimed in claim 3 wherein the seat portion bearing surfaces are provided in bearing blocks arranged at either side of the seat portion.

6. A seating arrangement as claimed in claim 5 wherein a portion of the bearing block(s) adjacent the bearing surface(s) of the bearing block(s) is flared relative to the bearing surface(s).

7. A seating arrangement as claimed in claim 6 wherein said flared portion is frustoconical.

8. A seating arrangement as claimed in claim 6 wherein or flared portion is arranged inwardly of the bearing surface.

9. A seating arrangement as claimed in claim 1 wherein the seat portion comprises generally U-shaped slots for engagement over the beam.

10. A seating arrangement as claimed in claim 1 wherein said beam includes means for locating the mount in the correct orientation.

11. A seating arrangement as claimed in claim 10 wherein said locating means comprises one or more grooves extending along a length of said beam, for example along opposed faces of said beam.

12. A seating arrangement as claimed in claim 11 wherein the faces of the beam incorporating the locating groove or grooves are formed as parallel, planar surfaces.

13. A seating arrangement as claimed in claim 11 wherein said mount comprises one or more ribs or blocks for engagement with said groove or grooves.

14. A seating arrangement as claimed in claim 1 wherein said stops are provided in oppositely facing pairs.

15. A seating arrangement as claimed in claim 1 wherein a downward pivoting stop is provided on said base part and said clamp part.

16. A seating arrangement as claimed in claim 1 wherein said lugs or pins project into said mount(s) for engagement with said stop or stops.

17. A seating arrangement as claimed in claim 1 wherein said pins or lugs are manufactured separately from and attached to said seat portion.

18. A seating arrangement as claimed in claim 1 wherein guide means are provided between said mount and said seat portion.

19. A seating arrangement as claimed in claim 18 wherein said guide means comprises said arcuate recess or track, said arcuate guide or track acting as a bearing surface for said lug or pin.

20. A seating arrangement as claimed in claim 1 wherein said mount has an arcuate upper surface for engaging an arcuate portion of said beam, the effective radius of curvature of the mount portion being greater than that of said beam.

21. A seating arrangement as claimed in claim 1 wherein the mount(s) or seat portion are provided with damping means for damping the upward rotation of the seat portion towards the end of its travel.

22. A seating arrangement as claimed in claim 21 wherein said damping means includes a bow spring mounted on one or other of the parts so as to contact the other part when the seat is approaching its vertical position.

23. A seating arrangement as claimed in claim 1 wherein the mount(s) or seat portions are provided with a spring to provide an initial impetus for the upward rotation of the seat portion.

24. A seating arrangement as claimed in claim 1 wherein said beam is mounted to a stanchion by one or more brackets extending between said beam and said stanchion.

25. A seating arrangement for stadia and the like, the arrangement comprising:

a beam for receiving one or a plurality of seats; and at least one seat, said seat comprising:

a backrest portion fixedly mounted to said beam; and a seat portion mounted for pivotal movement about said beam from a seating position to a non-seating position, wherein said seat portion is retained on said beam by one or more mounts, the or each mount comprising a base part which is attached to or integrally formed with the backrest portion and a clamp part, the beam being clamped between said base part and said clamp part, and wherein said one or more mounts or said seat portion comprises an arcuate recess and the other of said one or more mounts or said seat portion is provided with a lug or a pin, said lug or said pin being received within the arcuate recess, the one or more mounts further comprising a stop cooperable with said lug or said pin for limiting the pivotal movement of said seat portion.

* * * * *